United States Patent [19]

Cheung

[11] Patent Number: 4,811,590

[45] Date of Patent: Mar. 14, 1989

[54] ROLL DIE ASSEMBLY WITH MISALIGNMENT DAMAGE PROTECTION

[75] Inventor: Kwun-Wing W. Cheung, Kent, Wash.

[73] Assignee: The Boeing Company, Seattle, Wash.

[21] Appl. No.: 157,476

[22] Filed: Feb. 16, 1988

[51] Int. Cl.[4] ..... B21D 19/00

[52] U.S. Cl. ..... 72/482; 72/3; 72/465; 29/243.52

[58] Field of Search ..... 29/243.52; 72/3, 4, 72/465, 478, 482

[56] References Cited

U.S. PATENT DOCUMENTS

| | | | |
|---|---|---|---|
| 2,089,795 | 8/1937 | Hodge | 29/84 |
| 3,197,854 | 8/1965 | Rohe et al. | 29/455 |
| 3,348,292 | 10/1967 | Turner et al. | 29/237 |
| 3,693,247 | 9/1972 | Brown | 29/512 |
| 3,875,653 | 4/1975 | Schoepe et al. | 29/507 |
| 3,938,239 | 2/1976 | Lauth | 29/512 |
| 4,235,013 | 11/1980 | Volmer | 29/727 |

OTHER PUBLICATIONS

Specification Sheet from General Magnaplate, Ventura, California re Nedox ® (undated).

*Primary Examiner*—Lowell A. Larson
*Attorney, Agent, or Firm*—Joan H. Pauly

[57] ABSTRACT

A die assembly (12) has a die (14) with a nose (16) positioned to project into the hollow end (106) of an insert (102) being installed in a panel workpiece (100). A pilot pin (32) projects outwardly form the center of the nose (16) and into the insert (102) when the workpiece (100) is properly aligned. The pin (32) is mounted to slide axially relative to the die (14). The pin (32) is biased outwardly but yields under forces exceeding a predetermined magnitude. When the panel (100) is misaligned and a ram (8) urges the panel (100) against the pin (32), the pin (32) retracts to prevent damage to the panel (100). Thrust plates (64) support the die (14) and move radially inwardly when the pin (32) retracts. Feet (22) on the die (14) are received into grooves (70) on the thrust plates (64) to allow the die (14) to retract and thereby prevent the nose (16) from damaging the workpiece (100).

14 Claims, 5 Drawing Sheets

ROLL DIE ASSEMBLY WITH MISALIGNMENT DAMAGE PROTECTION

DESCRIPTION

1. Technical Field

This invention relates to systems in which roll forming is accomplished in a press and, more particularly, to such a system in which a pilot pin is received into a workpiece to align the workpiece and in which the pilot pin retracts against the force of a spring when the workpiece is misaligned to allow retraction of thrust plates which support the workpiece and thereby provide clearance to prevent damage to the workpiece when the press is actuated in a misalignment condition.

2. Background Art

The floor panels in aircraft are commonly formed from composite materials and have a structure consisting of a honeycomb core sandwiched between two opposite skins. The panels are reinforced at attachment points by aluminum inserts. A common type of insert has a flanged end and an opposite hollow cylindrical end. The cylindrical end is inserted into a predrilled hole in a floor panel and is secured in place by roll forming. The present practice is to carry out the roll forming in a power press. The roll die in the press has a fixed pilot pin which is used to locate and align the insert and the panel in the press. The operator manually positions the panel until it drops down onto the pilot pin.

A problem that has been encountered in connection with this procedure is that the press is sometimes actuated accidentally when the panel is not properly aligned on the pilot pin. The actuation of the press with the panel misaligned frequently damages the panel beyond repair. The panel must then be discarded. Since the fabrication of the panels is relatively labor intensive and expensive, the losses incurred when panels are damaged beyond repair adds significantly to the cost of producing the aircraft. In addition, the occurrence of damage to the panels decreases the productivity of the press operator and the overall efficiency of the roll forming system.

U.S. Pat. No. 3,197,854, granted Aug. 3, 1965, to F. W. Rohe et al., discloses a method of applying an insert or spacer type fastener to a sandwich panel, such as an aircraft floor panel. The method is carried out using a power press or portable squeeze tooling. The fastener that is installed includes a plug portion and a sleeve portion which are inserted into opposite sides of the panel. With the head end of the plug portion supported by an anvil, a ram is urged against the end of the sleeve portion opposite the anvil. The ram carries a fixed cylindrical pilot that is received into the plug bore.

Spring biased locating pins are disclosed in each of U.S. Pat. Nos. 2,089,795, granted Aug. 10, 1937, to H. M. Hodge; 3,693,247, granted Sept. 26, 1972, to C. K. Brown; and 3,938,239, granted Feb. 17, 1976, to C. Lauth. In the Hodge apparatus, the spring biased locating pin or centering plunger is received into an opening in a die to position a center punch accurately relative to a punch support block. The center punch then forms a recess on the support block to provide a guide for accurately mounting a punch retainer on the block. Brown discloses a method of installing a fastener assembly to join two structures. A sleeve portion of the fastener is positioned in aligned apertures in the structures, and a mandrel portion of the fastener is driven into the sleeve portion to expand the sleeve. The sleeve has a head end and an opposite end that is upset to form a flange and engage the edge of the aperture. The driving of the mandrel and the upsetting of the sleeve end are accomplished by clamping together the end of the mandrel adjacent to the head end of the sleeve and a back-up ring which abuts the end of the sleeve to be upset. The back-up ring carries a spring loaded locating pin which extends into the sleeve portion. Lauth discloses a method and apparatus for forming a self-flanging nut for use in automobile sheet metal parts. The apparatus includes a press with a plurality of springs for positioning plates carried by a first movable platen and for biasing a die member with an upper locating pin portion upwardly away from a force transmitting member. The springs apparently sequence movement of the elements of the press.

U.S. Pat. No. 3,348,292, granted Oct. 24, 1967, to G. L. Turner et al., discloses apparatus for mounting hose couplings. A hose end with a coupling positioned thereon is slipped over expansion fingers of the apparatus. A cylinder is actuated to spread the fingers and close crimping dies to secure the coupling to the hose end. The fingers are spread by upward movement of a bayonet member between the fingers. The crimping dies are moved radially inwardly by upward movement of a cylindrical ring. Movement of the ring causes pivoting of links that are pivotably attached to the ring and to a slide member that carries the dies.

U.S. Pat. No. 3,875,653, granted Apr. 8, 1975, to A. Schoepe et al., discloses a swaging machine for forming an end portion of an elongated tubular workpiece. The workpiece is positioned vertically with the end to be swaged facing downwardly. A punch moves up to swage the lower end of the workpiece. The downstroke of the punch is cushioned by a spring. During the swaging operation, the upper end of the tubular workpiece is in contact with a yieldable weight which bounces up in response to the impact force of the punch. The yieldable weight provides the resistance necessary for the swaging operation but at the same time yieldably absorbs a sufficient portion of the impact force to prevent deformation of the unsupported portion of the tubular workpiece between the two ends. When the weight bounces up, it is gripped by the magnetic field of an electromagnet, and the combined weight of the yieldable weight and the magnet compresses a spring that biases the magnet upwardly.

The above patents and the prior art that is discussed and/or cited therein should be studied for the purpose of putting the present invention into proper perspective relative to the prior art.

DISCLOSURE OF THE INVENTION

A subject of the invention is an improvement for use in a press of the type having first and second opposing members that are axially movable relative to each other to exert a force on a workpiece positioned therebetween, and a pilot pin carried by the first member and adapted to be received into an opening in the workpiece. According to an aspect of the invention, the improvement comprises mounting means for mounting the pin to slide axially relative to the first member. The pin is biased axially outwardly toward the second member by biasing means. The biasing means is yieldable to allow the pin to move axially inwardly when the pin is misaligned with the opening in the workpiece and the first and second members are moved axially toward each other. This prevents the pin from damaging the workpiece. Retracting means, responsive to axially inward movement of the pin, is provided for allowing the first member to move axially inwardly to thereby provide clearance for the workpiece between the first and second members.

A preferred feature of the invention is retracting means which comprises a thrust plate and moving means. The thrust plate has an axially outer support surface that supports the first member when the pin is in an axially outward position. The moving means is responsive to axially inward movement of the pin and moves the thrust plate radially to allow the first member to move axially inwardly.

Another preferred feature of the invention is a projection and groove arrangement. The first member has a projection extending axially inwardly therefrom. The projection is positioned to abut the support surface of the thrust plate when the pin is in an axially outward position. The thrust plate has a groove opening onto the support surface. The groove is positioned to receive the projection when the thrust plate is moved by the moving means. This preferred feature relieves pressure on the workpiece and helps to ensure that the first member remains retracted until the first and second members are moved apart when there is a misalignment. It also provides solid support for the first member during normal operation of the press.

Preferably, the moving means comprises a cam surface on the thrust plate, and a cam surface on the pin that engages the cam surface on the thrust plate as the pin moves axially inwardly. This arrangement helps to ensure smooth and reliable functioning of the invention.

The moving means preferably also comprises biasing means for biasing the thrust plate radially inwardly into contact with the pin. The pin has reduced diameter portions that move into axial alignment with the thrust plate as the pin moves axially inwardly. The reduced diameter portions of the pin may be formed, for example, by the cam surface described above.

Another subject of the invention is an improved die structure of the type having a die with a nose positioned to project into the hollow end of a sleeve insert in a workpiece to roll form such end when an opposing member urges the insert against the die, and a pilot pin extending axially outwardly from the nose. According to an aspect of the invention, the improvement comprises mounting means for mounting the pin to slide axially relative to the die. Biasing means biases the pin axially outwardly. The biasing means is yieldable to allow the pin to move axially inwardly when the pin is misaligned with the insert and the die and the opposing member are moved relatively toward each other, to thereby prevent the pin from damaging the workpiece. Retracting means, responsive to axially inward movement of the pin, allows the die to move axially inwardly to thereby provide clearance for the workpiece between the nose and the opposing member. The die structure may also include some or all of the preferred features discussed above.

The improvement of the invention solves the problems discussed above that have been encountered in connection with installing metal inserts in composite material aircraft floor panels. The retracting of the pilot pin and the die avoids damage to the panel when the pin is misaligned with the insert, to thereby avoid the significant additional cost of replacing damaged panels. The use of the improvement of the invention also increases the productivity of the operator of the press and of the press itself to further reduce the overall cost of manufacture. The improvement of the invention has a relatively simple, durable structure and can be used in existing press installations. Therefore, the improvement may be provided and maintained at a reasonable cost. The operation of the invention is essentially foolproof and does not require any special operator training. Rather than requiring specialized skill, the invention helps to compensate for lack of skill or in attention by an operator. The invention is very versatile and may be used in various environments in order to avoid damage to a workpiece in a press structure including a pilot pin arrangement.

These and other advantages and features will become apparent from the detailed description of the best mode for carrying out the invention that follows.

BRIEF DESCRIPTION OF THE DRAWINGS

In the drawings, like element designations refer to like parts throughout, and.

BEST MODE FOR CARRYING OUT THE INVENTION

The drawings show a die assembly 12 that is constructed according to the invention and that also constitutes the best mode for carrying out the invention currently known to the applicant. In FIGS. 1 and 3–6, the assembly 12 is shown being used in a roll die press to install a metal insert 102 in a composite material, honeycomb core panel 100 of the type used in aircraft floor structures. It is anticipated that the primary use of the improvement of the invention will be in the manufacture of aircraft floor plans, as illustrated in FIGS. 1 and 3–6. However, it is of course to be understood that the improvement of the invention may also be used to advantage in other types of systems in which misalignment with a pilot pin can result in damage to a workpiece.

Figure 1:
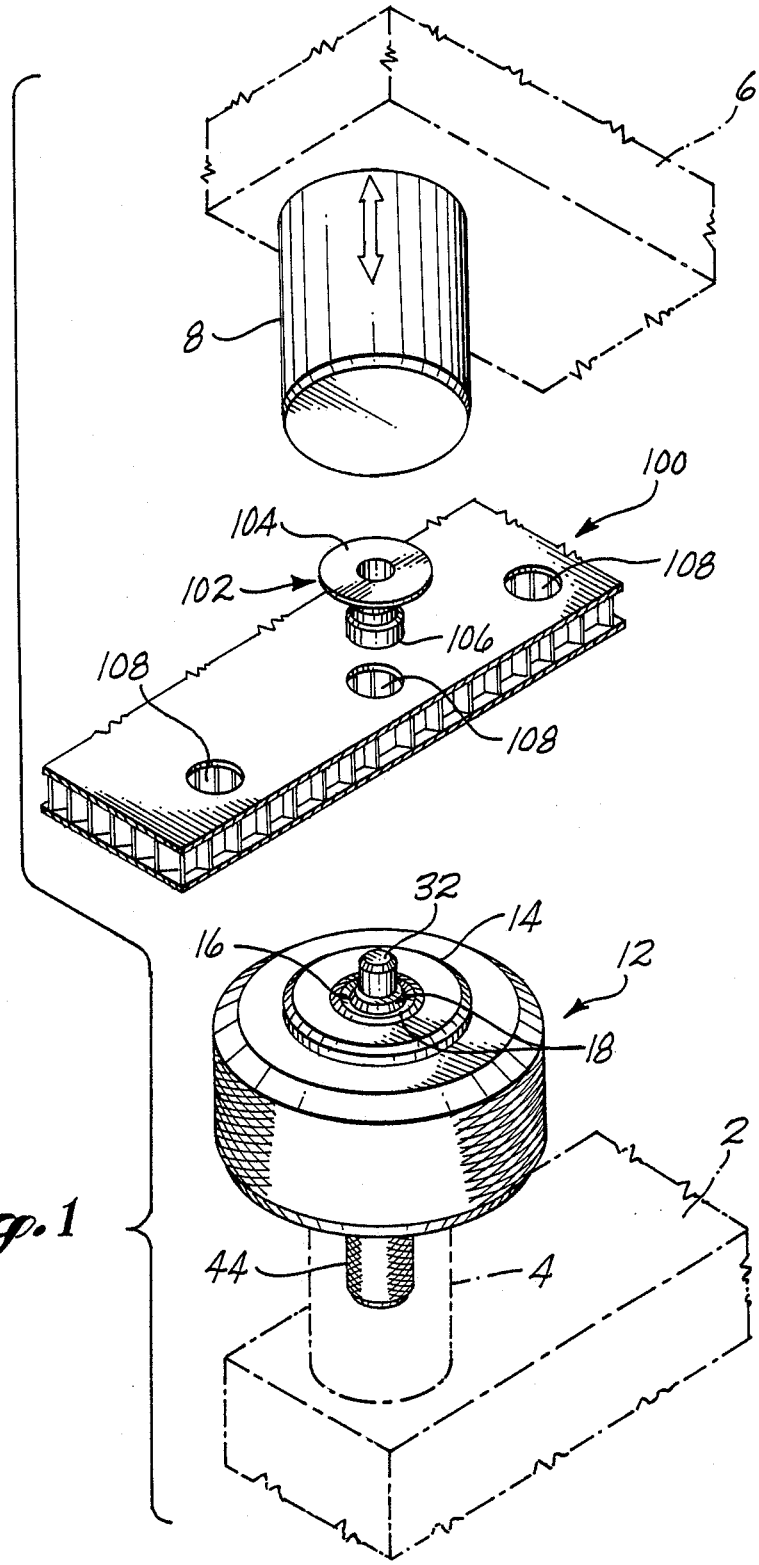
FIG. 1 is a pictorial view of the preferred embodiment of the die structure of the invention shown with portions of the press structure and a workpiece.
Figure 3:
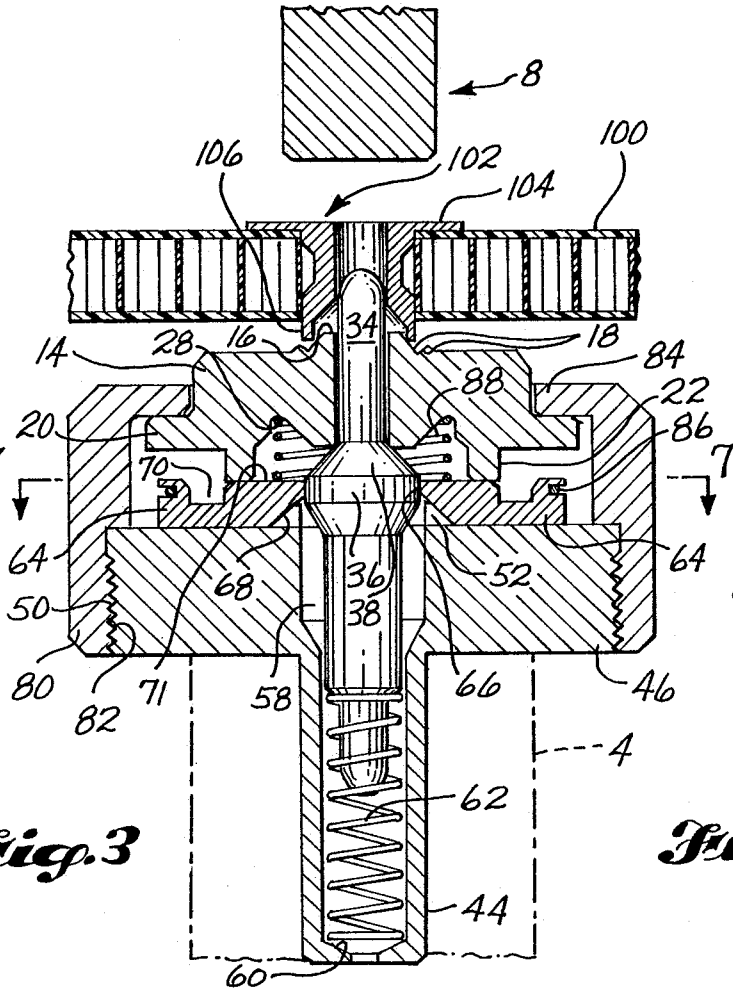
FIG. 3 is a vertical sectional view of the preferred embodiment, a workpiece, and a ram at the beginning of the roll forming procedure.

Referring to FIG. 1, the die assembly 12 is shown mounted on a mounting lug 4 of a press die support 2. The press also includes a ram 8 which is carried by a ram mounting structure 6. A portion of an aircraft floor panel 100 and an aluminum insert 102 are also shown in FIG. 1. For the purposes of illustration, the panel 100 and insert 102 are shown disassembled and separated from the die assembly 12. The panel 100 includes a plurality of predrilled holes 108. Prior to the roll forming installation procedure, the shaft of the insert 102 is inserted into one of these holes 108. A radial flange 104 on one end of the insert 102 abuts the outer surface of one of the panel skins, and the opposite hollow cylindrical end 106 of the insert projects from the opposite skin of the panel 100. With the insert 102 thus positioned in the panel 100, the panel 100 is positioned as shown in FIG. 3 for the roll forming operation. The flange 104 faces the ram 8, and a pilot pin 32 carried by the die assembly 12 and the nose structure 16 of the die assembly 12 are received into the hollow cylindrical end 106 of the insert 102. The roll forming procedure is described further below.

Figure 4:
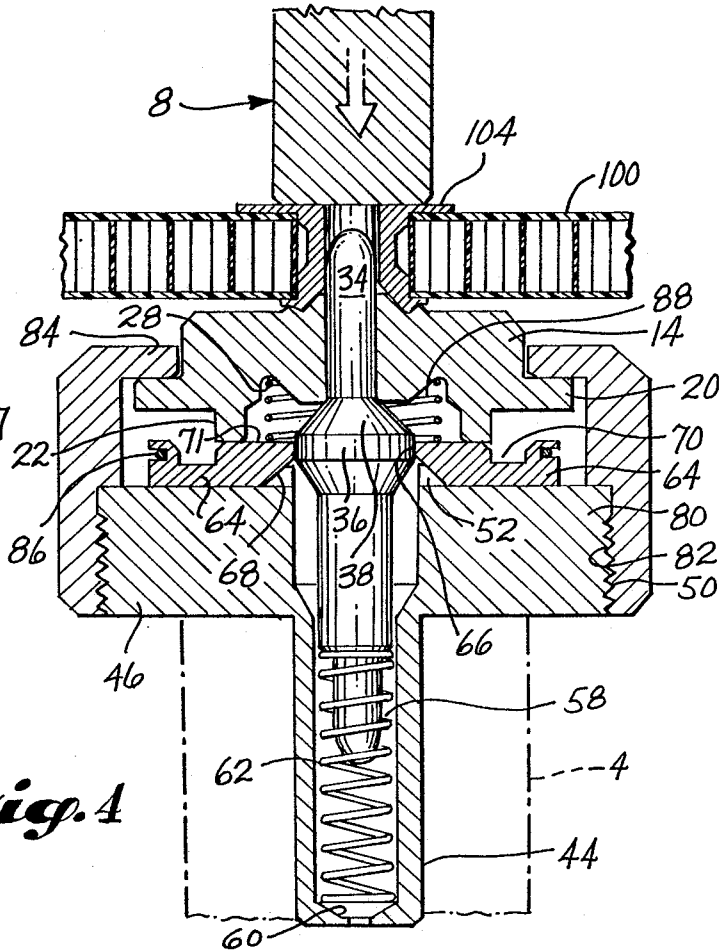
FIG. 4 is like FIG. 3 except that it shows the roll forming procedure near completion.

The parts of the roll die assembly 12 are shown in FIGS. 2-9A. Referring to FIGS. 2-6, the assembly 12 includes a die 14 having a main body portion 15. A mounting flange 20 projects radially from the body 15 to hold the die 14 inside a cover 80, described below. A nose 16 projects axially outwardly from the outer radial face of the body 15. The nose 16 has an inner frustoconical portion and an outer ridge portion which together form a roll die surface 18. The hollow cylindrical end 106 of the insert 102 is formed against this roll die surface 18, as shown in FIG. 4. Four circumferentially spaced rectangular feet 22 project axially inwardly from the inner radial surface of the die 14. An axial opening 24 extends through the body 15 of the die 14 and the center of the nose 16. An annular groove 28 is formed on the inner radial surface of the body 15 surrounding the axial opening 24. This groove 28 provides a spring abutment for a spring 88. A plurality of holes (not shown) for guide pins are also formed on the inner radial surface. Preferably, four such holes are provided for two guide pins 48. The four holes facilitate positioning of the die 14 relative to the guide pins 48.

The assembly 12 also includes a pilot pin 32. The pin 32 has a cylindrical axially outer portion 34 with a tapered end. In the assembled die assembly 12, the outer portion 34 projects axially outwardly from the center of the nose 16, as shown in FIGS. 1 and 3-5. The pin 32 has an enlarged diameter portion that forms a cylindrical abutment surface 36. The diameter of the pin 32, moving in an axially outward direction, reduces gradually from the maximum diameter of the abutment surface 36 to the diameter of the axially outer portion 34. The reduced diameter portions between the outer portion 34 and the abutment surface 36 form a frustoconical cam surface 38. Axially inwardly of the abutment surface 36, the pin 32 has an inwardly tapering frustoconical surface, and then two generally cylindrical portions. A shoulder 40 is formed between the two cylindrical portions and provides a spring abutment for a spring 62.

Figure 2:
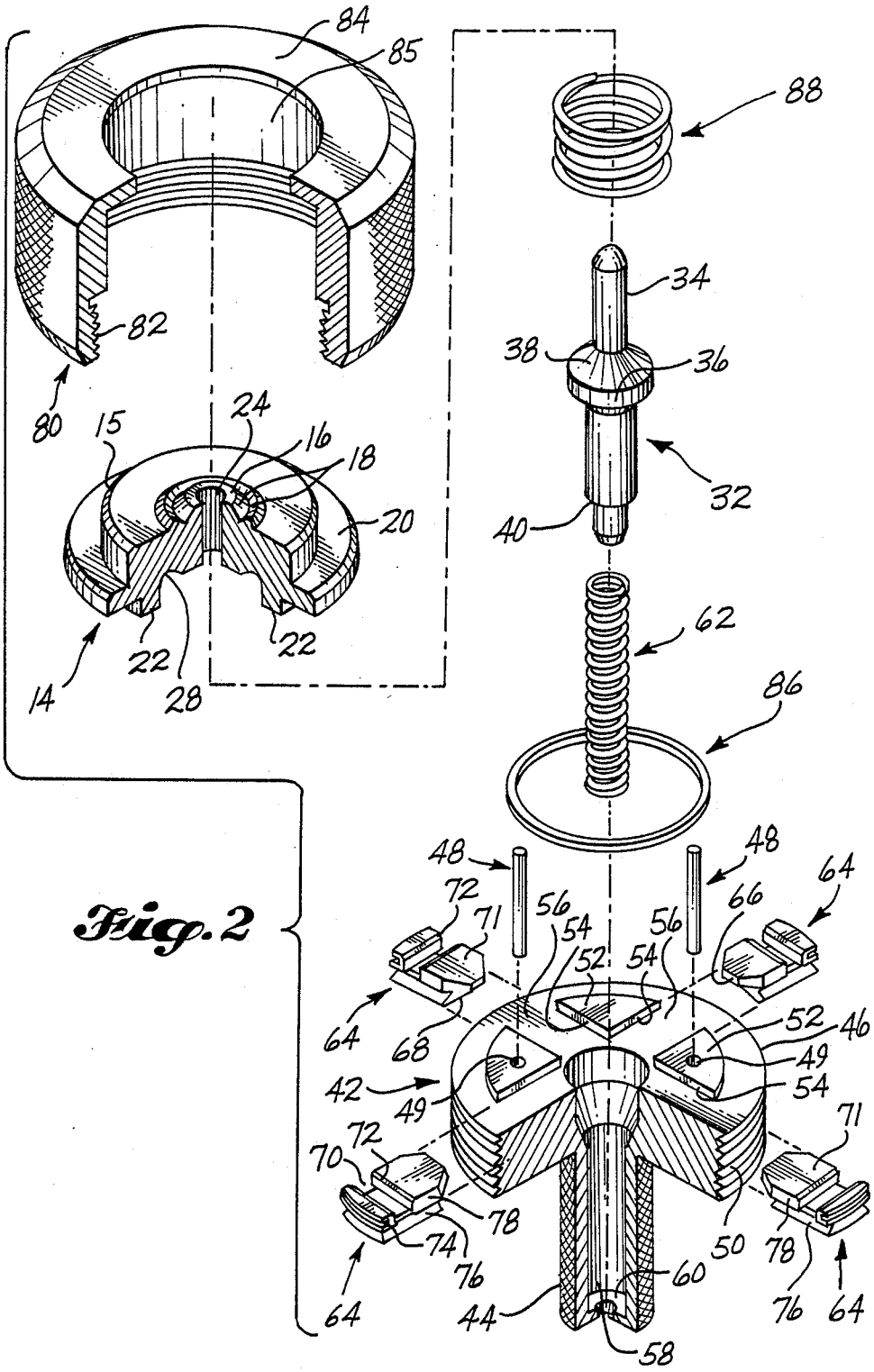
FIG. 2 is an exploded pictorial view of the preferred embodiment of the die structure shown in FIG. 1, with foreground portions cut away.
Figure 7:
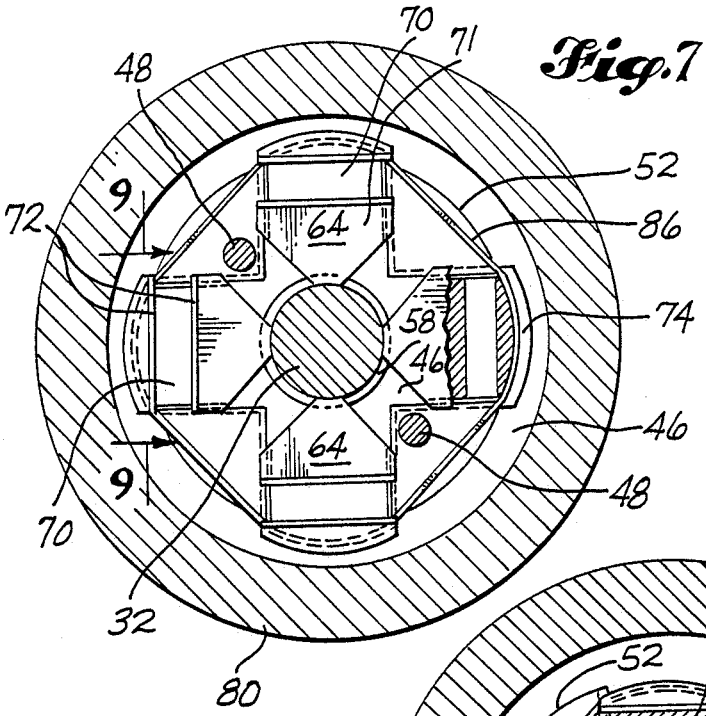
FIG. 7 is a sectional view taken along the line 7—7 in FIG. 3, with foreground portions of one thrust plate cut away.
Figure 8:
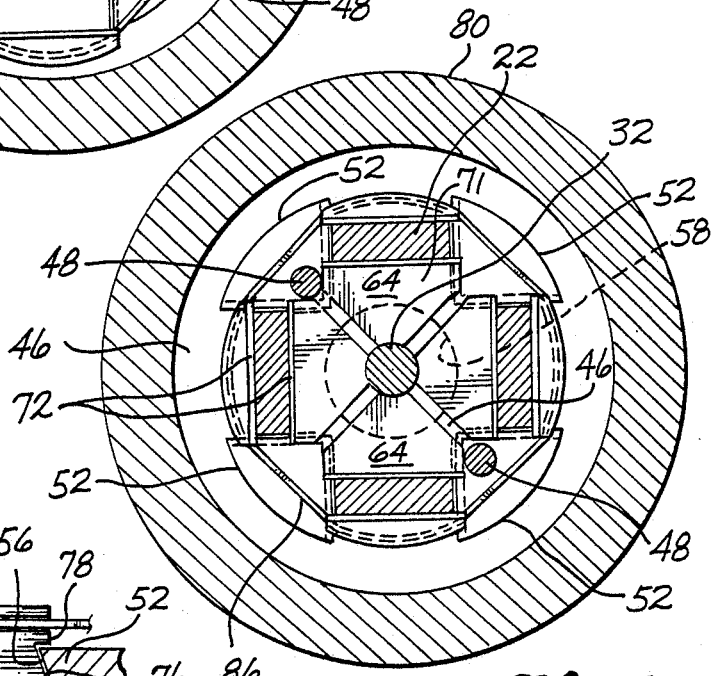
FIG. 8 is a sectional view taken along the line 8—8 in FIG. 6.

The die 14 is supported by thrust plates 64 carried by a support member 42. The member 42 includes a support plate 46 and a mounting shaft 44 for mounting the assembly 12 on the die support 2 of the press, as shown in FIG. 1. Two holes 49 are formed in the support plate 46 for receiving guide pins 48, as shown in FIGS. 2, 7, and 8. The guide pins 48 are received into the holes 49 and the holes in the die 14 described above to align the die 14 with the support plate 46 and thrust plates 64. The outer circumferential surface of the support plate 46 has threads 50 which threadedly engage threads 82 on the cover 80. The generally cylindrical cover 80 has a radial lip 84 on its axially outer end that engages the mounting flange 20 of the die 14 to hold the die 14 in position relative to the support plate 46 and thrust plate 64. The main body 15 of the die 14 projects axially outwardly from the opening 85 defined by the lip 84. An axial passageway 58 extends through the support plate 46 and down into the mounting shaft 44 for receiving the axially inner portion of the pilot pin 32, as shown in FIGS. 3-6. The passageway 58 terminates in a spring abutment 60. The spring 62 is positioned between the end of the passageway 58 and the shoulder 40 on the pilot pin 32 to bias the pilot pin 32 axially outwardly toward the ram 8.

Figure 6:
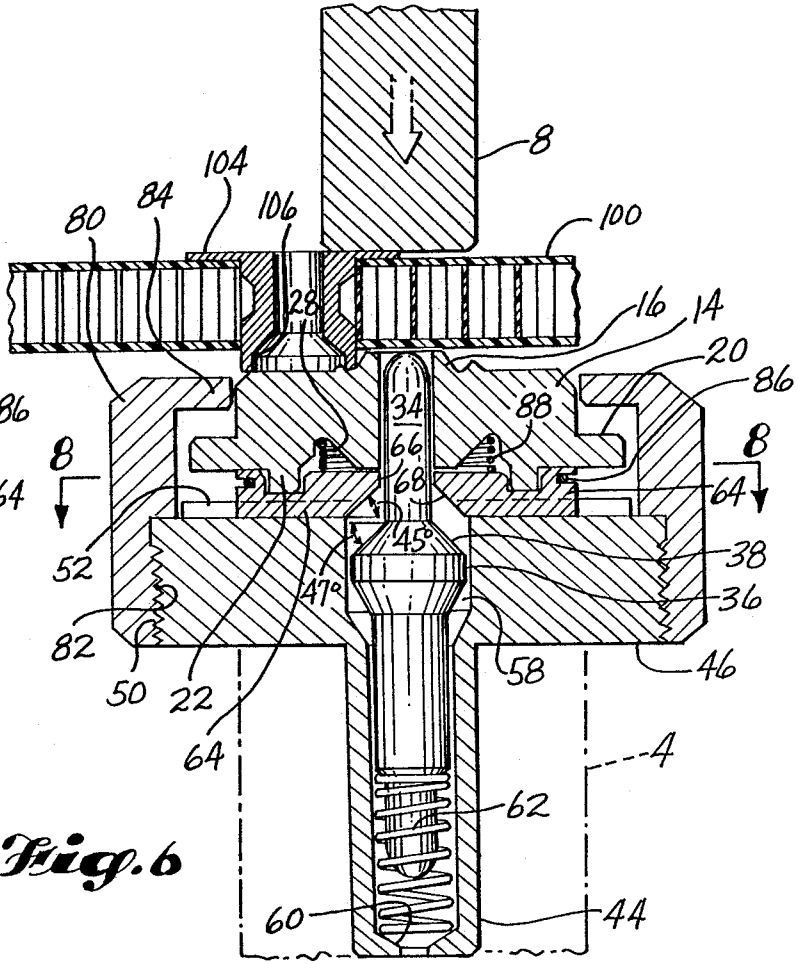
FIG. 6 is like FIG. 5 except that it shows the positions of the ram and the parts of the die structure when the ram reaches its limit of travel.

The thrust plates 64 support the die 14 during normal operation of the press, as shown in FIGS. 3 and 4, and are radially slidable to allow the die 14 to retract axially inwardly in a misalignment condition, as shown in FIG. 6. As shown in FIG. 2, in the preferred embodiment there are four circumferentially spaced thrust plates 64. Each thrust plate 64 has a radially inner axially extending abutment surface 66 and a cam surface 68 that tapers axially inwardly and radially outwardly from the abutment surface 66. A generally rectangular groove 70 is formed in the plate 64 and opens onto the axially outer radial support surface 71 thereof. The groove 70 is dimensioned to receive one of the four rectangular feet 22 formed on the die body 15. The outer edges of the groove 70 have bevels 72 to guide the foot 22 into the groove 70. The outer circumferential surface of the thrust plate 64 has a slot 74 formed therein for receiving a biasing ring 86. The ring 86 may be formed by, for example, a silicone rubber seal ring of a known type. The ring 86 engages each of the four thrust plates 64, as shown in FIGS. 7 and 8, to bias the plates 64 radially inwardly into contact with the pilot pin 32.

Figure 9:
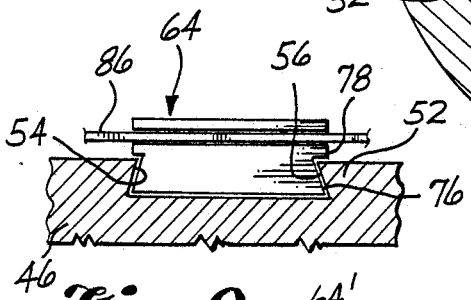
FIG. 9 is a sectional view taken along the line 9—9 in FIG. 7.

Referring to FIGS. 2 and 7-9, the sliding movement of the thrust plates 64 radially inwardly and outwardly is guided by guideways 56 formed on the support plate 46. Four triangular bosses 52 are formed on the axially outer radial surface of the support plate 46 and define therebetween the guideways 56. The bosses 52 have sloping edges 54 that mate with sloping edges 76 formed on the thrust plates 64 to guide the radial sliding movement of the thrust plates 64 and to restrain the thrust plates 64 axially. In the preferred embodiment shown in FIGS. 2 and 7-9, the edges 76 of the thrust plates 64 and the edges 54 of the triangular bosses 52 slope at an angle of about 45°. A flange 78 extends outwardly from each thrust plate 64 along the axially outer radial faces of the adjacent triangular bosses 52, as shown in FIGS. 7-9.

Figure 9A:
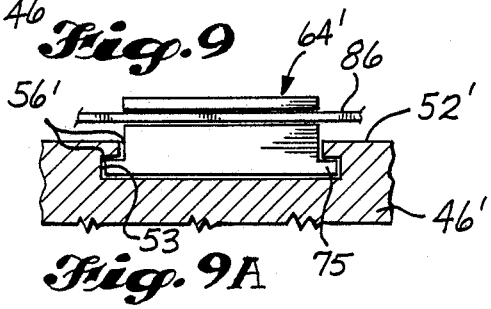
FIG. 9A is like FIG. 9 except that it shows a modified form of the thrust plate and its guideway.

FIG. 9A shows a modification of the arrangement shown in FIG. 9. In this modification, the triangular bosses 52' on the support plate 46' have straight, rather than sloping, edges. Each edge terminates in an inner rectangular recess 53. The resulting guideways 56' have a generally hat-shaped configuration, as opposed to the trapezoidal configuration shown in FIG. 9. The modified thrust plates 64' have straight, rather than sloping, edges which terminate in axially inner flanges 75 that engage the recesses 53 in the bosses 52'.

Figure 10:
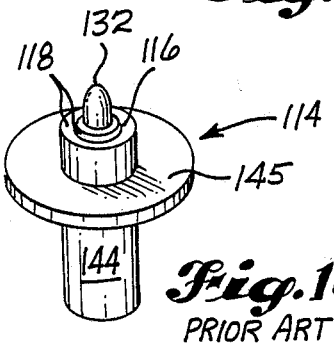
Fig. 10 PRIOR ART
FIG. 10 is a pictorial view of a die element of a type currently in use.

For the purposes of comparison, a die structure 114 of a known type is shown in FIG. 10. The structure 114 has a mounting shaft 144 for mounting the structure 114 on the die support 2 of a press in the manner that the die assembly 12 of the invention is shown mounted in FIG. 1. When the structure 114 is so mounted, a mounting plate 145 formed thereon abuts the axially outer end of the press mounting lug 4. The die structure 114 has an integral nose 116 with a roll die surface 118 The nose 116 and roll die surface 118 have essentially the same configuration as the nose 16 and roll die surface 18 of the die assembly 12 of the invention. A pilot pin 132 projects axially outwardly from the center of the nose 116. The pilot pin 132 is fixed relative to the die structure 114, including the nose 116, and is formed integrally therewith. Use of die structures such as that shown in FIG. 10 has led to the problem discussed above of damage to panel workpieces when the pin 132 is misaligned with the hollow cylindrical end 106 of an insert 102. Since the pin 132 is fixed and the workpiece 100 is urged against it when there is a misalignment, the pin 132 punctures the outer skin of the workpiece 100.

The operation of the die assembly 12 of the invention is as follows. During normal operation, the panel 100 is positioned on the die assembly 12 with the insert 102 properly aligned with the pilot pin 32 and the nose 16 on the die 14, as shown in FIG. 3. The outer portion 34 of the pilot pin 32 and the center of the nose 16 project into the hollow cylindrical end 106 of the insert 102. When the panel 100 is in position, the press is actuated to move the ram 8 toward the die 14. The position of the die assembly 12 relative to the ram 8 is preset to obtain the desired roll forming without damaging the panel 100 or the insert 102. This is accomplished by turning the mounting lug 4. A readjustment is made for each new workpiece 100 to adjust for differences in panel thickness due to manufacturing tolerances.

As shown in FIG. 4, the ram 8 urges the insert 102 against the roll die surface 18 of the die 14 to roll the edges of the end 106 radially outwardly and thereby secure the insert 102 to the panel 100. As can be seen in FIGS. 3, 4, and 7, during this normal operating procedure the pilot pin 32 remains fully extended, and the thrust plates 64 remain in their axially outward positions in which their abutment surfaces 66 abut the cylindrical abutment surface 36 of the pilot pin 32. Throughout the procedure, the feet 22 on the die 14 contact the support surfaces 71 of the thrust plates 64 so that the thrust plates 64 provide continuous support for the die 14. At the completion of the roll forming procedure, the ram 8 is retracted and the workpiece 100 is repositioned to install another insert 102.

Figure 5:
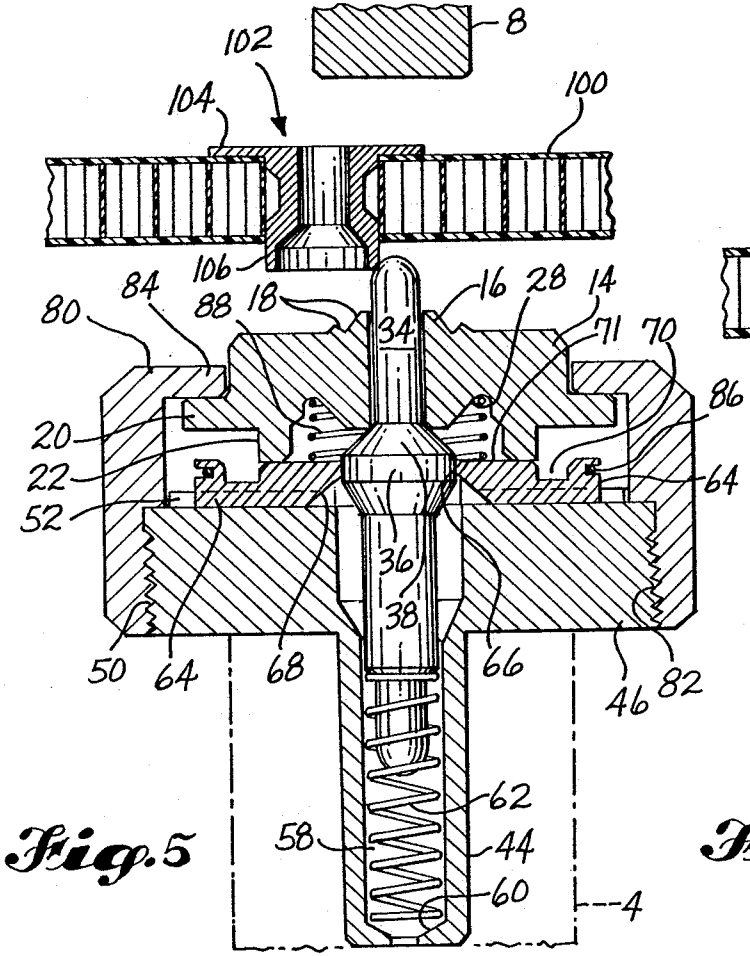
FIG. 5 is like FIG. 3 except that it shows the workpiece misaligned with the pilot pin.

FIGS. 5, 6, and 8 illustrate the operation of the die assembly 12 when there is a misalignment of the insert 102 and the pilot pin 32. FIG. 5 shows the panel 100 in a misaligned position prior to activation of the ram 8. FIG. 6 shows the positions of the misaligned panel 100 and the parts of the die assembly 12 when the ram 8 reaches its limit of travel. The sequence of events illustrated in FIGS. 5 and 6 can occur, for example, when the press is accidentally actuated before the operator has completed the positioning of the panel 100 or when the press is intentionally actuated by an operator who mistakenly believes that the panel 100 is properly positioned.

Referring to FIG. 6, the ram 8 urges the misaligned panel 100 against the outer portion 34 of the pilot pin 32. As the panel 100 is urged against the pilot pin portion 34, the pilot pin 32 retracts axially inwardly against the force of the biasing spring 62. The retracted position of the pilot pin 32 is shown in FIG. 6. The spring 62 is calibrated so that the pin 32 will support the weight of the panel 100 when there is no external force urging the panel 100 against the outer pin portion 34. The spring 62 yields and compresses under forces having a magnitude exceeding a predetermined magnitude that is greater than the force exerted by the weight of the panel 100. Preferably, this predetermined magnitude is less than the magnitude of the force exerted by the ram 8 to ensure that the pilot pin 32 retracts without causing any damage to the outer skin of the panel 100.

As the pilot pin 32 moves axially inwardly, the cam surface 38 on the pin 32 moves into axial alignment with the cam surfaces 68 on the thrust plates 64. The biasing ring 86 acts as a tension spring and moves the thrust plates 64 radially inwardly so that they remain in contact with the pilot pin 32. The engagement of the cam surfaces 38, 68 guides the retracting, radially inward movement of the thrust plates 64. Preferably, the radially outward and axially inward slopes of the thrust plate cam surfaces 38 and the pilot pin cam surface 68 are slightly different, 45° and 47°, respectively, as shown in FIG. 6, to avoid binding of the thrust plates 64 and pilot pin 32. The spring 88 exerts an axially inward force on the radially inner ends of the thrust plates 64 to ensure that they slide smoothly and do not jam in the guideways 56. When the abutment surfaces 66 of the thrust plates 64 come into axial alignment with the cylindrical surface of the outer portion 34 of the pilot pin 32, the thrust plates 64 are fully retracted. The pilot pin 32 continues to retract until it reaches its fully retracted position shown in FIG. 6.

As the pilot pin 32 is retracting axially inwardly and the thrust plates 64 are moving radially inwardly, the feet 22 on the die 14 slide along the axially outer radial support surfaces 71 of the thrust plates 64 and into the grooves 70. The movement of the feet 22 into the grooves 70 allows the die 14 to retract axially inwardly, as shown in FIG. 6, to provide clearance for the panel 100 between the ram 8 and the nose 16 of the die 14. This prevents the nose 16 from puncturing or otherwise damaging the panel 100.

The ram 8 automatically retracts when it has reached the limit of its stroke shown in FIG. 6. With the force of the ram 8 removed from the panel 100, the spring 88 moves the die 14 axially outwardly into its support position shown in FIGS. 3–5, and the spring 62 moves the pilot pin 32 axially outwardly toward its extended position shown in FIGS. 3–5. As the pilot pin 32 moves axially outwardly, the cam surface 38 on the pin 32 engages the cam surfaces 68 on the thrust plates 64 to move the thrust plates 64, against the force of the biasing ring 86, back to their support position shown in FIGS. 3–5. The die assembly 12 is then ready for the next roll forming cycle.

The type of aircraft floor panel 100 shown in FIGS. 1 and 3–6 may be made from various types of composite materials. For example, a typical panel might have a Nomex (trademark) honeycomb core sandwiched between two fiberglass skins. During the roll forming process, the adhesives used in the construction of this type of panel tend to bleed onto the roll die surface and surrounding structure. Since the presence of adhesives could interfere with the proper functioning of the die assembly 12, when the die assembly 12 is used in the type of procedure illustrated in FIG. 1, portions of the assembly 12 are preferably provided with a coating. For example, in the preferred embodiment, the die 14 and pilot pin 32 are provided with a coating that resists adhesion. An example of a suitable type of coating is one of about 0.0003 to 0.0007 inch thickness of the type of material sold by General Magnaplate of Ventura, Calif. under the trademark, Nedox. The coating resists adhesion and facilitates the cleaning of adhesive off the parts of the die assembly 12. This type of coating also toughens the coated surfaces so that they have greater resistance to wear. In addition, the coating reduces the need for oiling the movable parts of the assembly 12.

The process of applying the coating tends to leave a residue that increases friction. Therefore, the coating on the abutment surface 36 and the cam surface 38 of the pilot pin 32 is preferably polished to remove the residue but not the coating itself. This helps ensure very low friction and proper retraction and return of the pin 32.

Although the preferred embodiment of the invention has been illustrated and described herein, it is intended to be understood by those skilled in the art that various modifications and omissions in form and detail may be made without departing from the spirit and scope of the invention as defined by the following claims.

What is claimed is:

1. For use in a press of the type having first and second opposing members that are axially movable relative to each other to exert a force on a workpiece positioned therebetween, and a pilot pin carried by said first member and adapted to be received into an opening in the workpiece, the improvement comprising:

mounting means for mounting the pin to slide axially relative to said first member;

biasing means for biasing the pin axially outwardly toward said second member; said biasing means being yieldable to allow the pin to move axially inwardly when the pin is misaligned with said opening and said members are moved axially toward each other, to thereby prevent the pin from damaging the workpiece; and retracting means, responsive to axially inward movement of the pin, for allowing said first member to move axially inwardly to thereby provide clearance for the workpiece between said first and second members.

2. The improvement of claim 1, in which the retracting means comprises a thrust plate with an axially outer support surface that supports said first member when the pin is in an axially outward position; and moving means, responsive to axially inward movement of the pin, for moving the thrust plate radially to allow said first member to move axially inwardly.

3. The improvement of claim 2, in which said first member has a projection that extends axially inwardly therefrom and that is positioned to abut said support surface when the pin is in an axially outward position, and the thrust plate has a groove that opens onto said support surface and that is positioned to receive said projection when the thrust plate is moved by said moving means.

4. The improvement of claim 3, in which the moving means comprises a cam surface on the thrust plate, and a cam surface on the pin that engages said cam surface on the thrust plate as the pin moves axially inwardly.

5. The improvement of claim 2, in which the moving means comprises a cam surface on the thrust plate, and a cam surface on the pin that engages said cam surface on the thrust plate as the pin moves axially inwardly.

6. The improvement of claim 2, in which the moving means comprises biasing means for biasing the thrust plate radially inwardly into contact with the pin, and the pin has reduced diameter portions that move into axial alignment with the thrust plate as the pin moves axially inwardly.

7. The improvement of claim 2, in which the moving means comprises biasing means for biasing the thrust plate radially inwardly into contact with the pin, a cam surface on the thrust plate, and a cam surface on the pin that engages said cam surface on the thrust plate as the pin moves axially inwardly; and said first member has a projection that extends axially inwardly therefrom and that is positioned to abut said support surface when the pin is in an axially outward position, and the thrust plate has a groove that opens onto said support surface and that is positioned to receive said projection when the thrust plate is moved by said moving means.

8. An improved die structure of the type having a die with a nose positioned to project into the hollow end of a sleeve insert in a workpiece to roll form said end when an opposing member urges the insert against the die, and a pilot pin extending axially outwardly from the nose, wherein the improvement comprises:

mounting means for mounting the pin to slide axially relative to the die;

biasing means for biasing the pin axially outwardly; said biasing means being yieldable to allow the pin to move axially inwardly when the pin is misaligned with the insert and the die and the opposing member are moved relatively toward each other, to thereby prevent the pin from damaging the workpiece; and retracting means, responsive to axially inward movement of the pin, for allowing the die to move axially inwardly to thereby provide clearance for the workpiece between the nose and the opposing member.

9. The die structure of claim 8, in which the retracting means comprises a thrust plate with an axially outer support surface that supports the die when the pin is in an axially outward position; and moving means, responsive to axially inward movement of the pin, for moving the thrust plate radially to allow the die to move axially inwardly.

10. The die structure of claim 9, in which the die has a projection that extends axially inwardly therefrom and that is positioned to abut said support surface when the pin is in an axially outward position, and the thrust plate has a groove that opens onto said support surface and that is positioned to receive said projection when the thrust plate is moved by said moving means.

11. The die structure of claim 10, in which the moving means comprises a cam surface on the thrust plate, and a cam surface on the pin that engages said cam surface on the thrust plate as the pin moves axially inwardly.

12. The die structure of claim 9, in which the moving means comprises a cam surface on the thrust plate, and a cam surface on the pin that engages said cam surface on the thrust plate as the pin moves axially inwardly.

13. The die structure of claim 9, in which the moving means comprises biasing means for biasing the thrust plate radially inwardly into contact with the pin, and the pin has reduced diameter portions that move into axial alignment with the thrust plate as the pin moves axially inwardly.

14. The die structure of claim 9, in which the moving means comprises biasing means for biasing the thrust plate radially inwardly into contact with the pin, a cam surface on the thrust plate, and a cam surface on the pin that engages said cam surface on the thrust plate as the pin moves axially inwardly; and the die has a projection that extends axially inwardly therefrom and that is positioned to abut said support surface when the pin is in an axially outward position, and the thrust plate has a groove that opens onto said support surface and that is positioned to receive said projection when the thrust plate is moved by said moving means.

* * * * *